US006298783B1

(12) United States Patent
O'Mera et al.

(10) Patent No.: US 6,298,783 B1
(45) Date of Patent: Oct. 9, 2001

(54) PRINTHEAD ALIGNMENT DEVICE AND METHOD OF USE

(75) Inventors: Neil E. O'Mera, Woodbury; James R. Meier, St. Paul; Steven J. Brand, Savage, all of MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 09/430,714

(22) Filed: Oct. 29, 1999

(51) Int. Cl.[7] ..... B41J 29/393

(52) U.S. Cl. ..... 101/486; 347/19; 101/DIG. 36

(58) Field of Search ..... 400/691, 703, 400/706, 706.1, 709.1; 101/486, DIG. 36, 382.1; 347/1, 2, 19, 171, 197, 260

(56) References Cited

U.S. PATENT DOCUMENTS 5,500,801 * 3/1996 Löffler ..... 101/486
5,676,058 * 10/1997 Ireton ..... 101/486
5,850,789 * 12/1998 Rudolf et al. ..... 101/486
5,964,032 * 10/1999 Orikasa et al. ..... 347/19
6,003,980 * 12/1999 Sheinman et al. ..... 347/19
6,055,908 * 5/2000 Van Der Horst ..... 101/486
6,085,658 * 7/2000 Goldstein ..... 347/260

* cited by examiner

*Primary Examiner*—Eugene Eickholt
(74) *Attorney, Agent, or Firm*—Westman, Champlin & Kelly, P.A.

(57) ABSTRACT

A printhead is mounted in a support frame that has reference mounting members on the sides of the frame that establish a reference plane for mounting the support frame in a printer The printhead is adjustable on the support frame relative to the reference plane about a pivot axis on the support frame and also laterally of the reference plane. A fixture is used for mounting the support frame with the reference mounting members in a known location, and the position of a print line of the printhead relative to a reference location established by a camera and monitor is adjusted until the print line is in a predetermined position. The camera provides a view of the print line relative to the predetermined position, and the printhead is adjusted on the support frame until the location of the print line viewed by the camera is at the proper position The printhead is then fixed to the support frame.

15 Claims, 7 Drawing Sheets

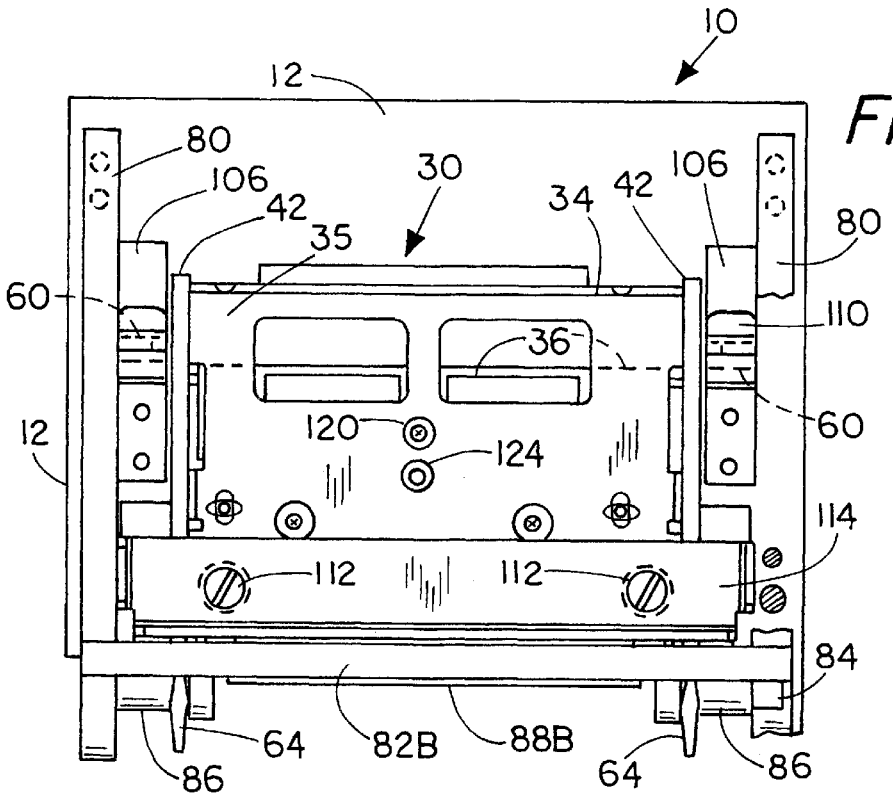
FIG. 6
FIG. 7
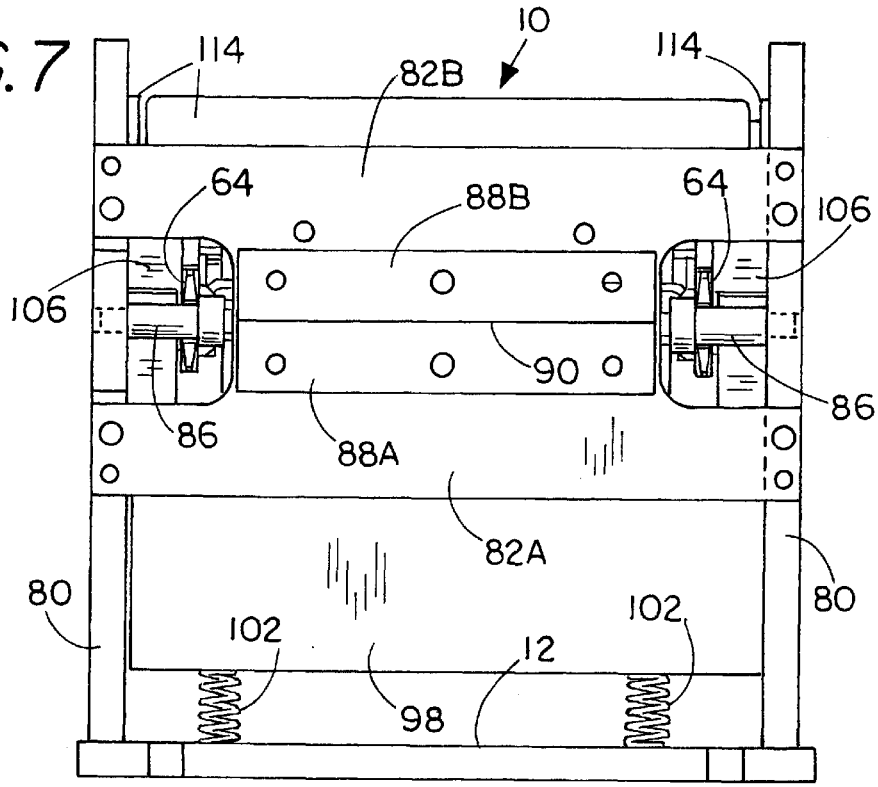

PRINTHEAD ALIGNMENT DEVICE AND METHOD OF USE

CROSS REFERENCE TO RELATED APPLICATION

Reference is made to copending application Ser. No. 09/430,712, filed on Oct. 29, 1999 for PRINTHEAD MOUNTING GUIDE FRAME, owned by the same assignee of this application and incorporated by reference.

BACKGROUND OF THE INVENTION

The present invention relates to an alignment device for mounting an alignable part, such as a thermal printhead, on a support frame that can be independently guided to position the working component in a mounting housing structure. The alignment device provides for precise alignment of a line on the working part, such as a print line of thermal print elements, relative to close fitting guides on the support frame so when put into use the working component is guided into its proper location. Proper alignment of thermal printheads, in particular, as well as other working components that have a narrow line of contact with another element is critical to satisfactory operation.

Conventional thermal printheads are held by a variety of different types of supports. In particular since printheads must be moved for servicing ribbons, pivoting frames are used for moving the printheads between a working and an open position. The printhead is pivoted 90° away from the platen used with the printhead. Obtaining accurate alignment of the printhead when moved back into working position relative to the platen has been a problem.

Also, in the copending application cross referenced above, a structure for supporting the printhead so that it will remain oriented in space as it is moved to open position to keep the print line facing away from operators provides for pivotal mounting of the support for the printhead. The support or frame is guided directly onto the shaft of a platen roller. If the print line is oriented properly with the guides carried on the support mounting frame, the print line will be properly oriented relative to the platen during use.

SUMMARY OF THE INVENTION

The present invention relates to a mounting frame or support and an alignment device that aligns a line on a part such as the print line on a thermal printhead, that needs to be positively positioned relative to another member (a platen) when in a working position. Thermal printhead having a line of heated resistive elements for printing from a ribbon is formed with a separate housing, and has an edge along which the print line to be properly positioned is defined. In the case of the printhead, the print line has to be positively positioned relative to a rotating platen roller, both as to radial angle, and for parallel positioning relative to the axis of rotation of the roller.

A mounting frame that has reference supports provides guided support for the printhead. The printhead is adjustably mounted in the mounting frame and is fixed in place after aligning it properly. The mounting frame has a pair of side members joined together with a cross wall that spans the printhead, and the side members are provided with two datum locator or reference positions for locating the mounting frame on supports on a printer. The mounting frame is positively guided as shown relative to side plates of a printer housing, for one datum or reference location, and also is positively guided onto the platen roller shaft that extends out from the opposite ends of the platen roller so that a reliable, proper position is achieved when the guides are in place.

The alignment of the print line is inspected and checked with a video camera that has a screen display which can be provided with reference lines so that the image of the print line, displayed by the camera, with the mounting frame and printhead on a precisely formed fixture, can be observed as to whether or not it is within the limits. The printhead is then adjusted relative to the mounting frame as it remains supported on the fixtures, to insure that the printhead is aligned within set limits. Screw adjustments are used as shown for precisely adjusting the printhead relative to its support frame, and then fixing the printhead in position on the mounting frame.

The mounting frame is positively guided on the platen supports, and also on printer housing guide blocks to position the side members of the printhead mounting frame and thereby hold the printhead at a proper angle and precisely parallel to the axis of the platen, with which the printhead operates.

Other working components or parts can be aligned as disclosed to orient a transverse line on the working component appropriately with a mounting frame that is guided into position.

BRIEF DESCRIPTION OF THE DRAWINGS

FIG. 6 is a top plan view of the fixture of FIG. 5;

FIG. 7 is a front elevational view of the fixture of FIG. 5;

DETAILED DESCRIPTION OF THE ILLUSTRATIVE EMBODIMENTS

Figure 1:
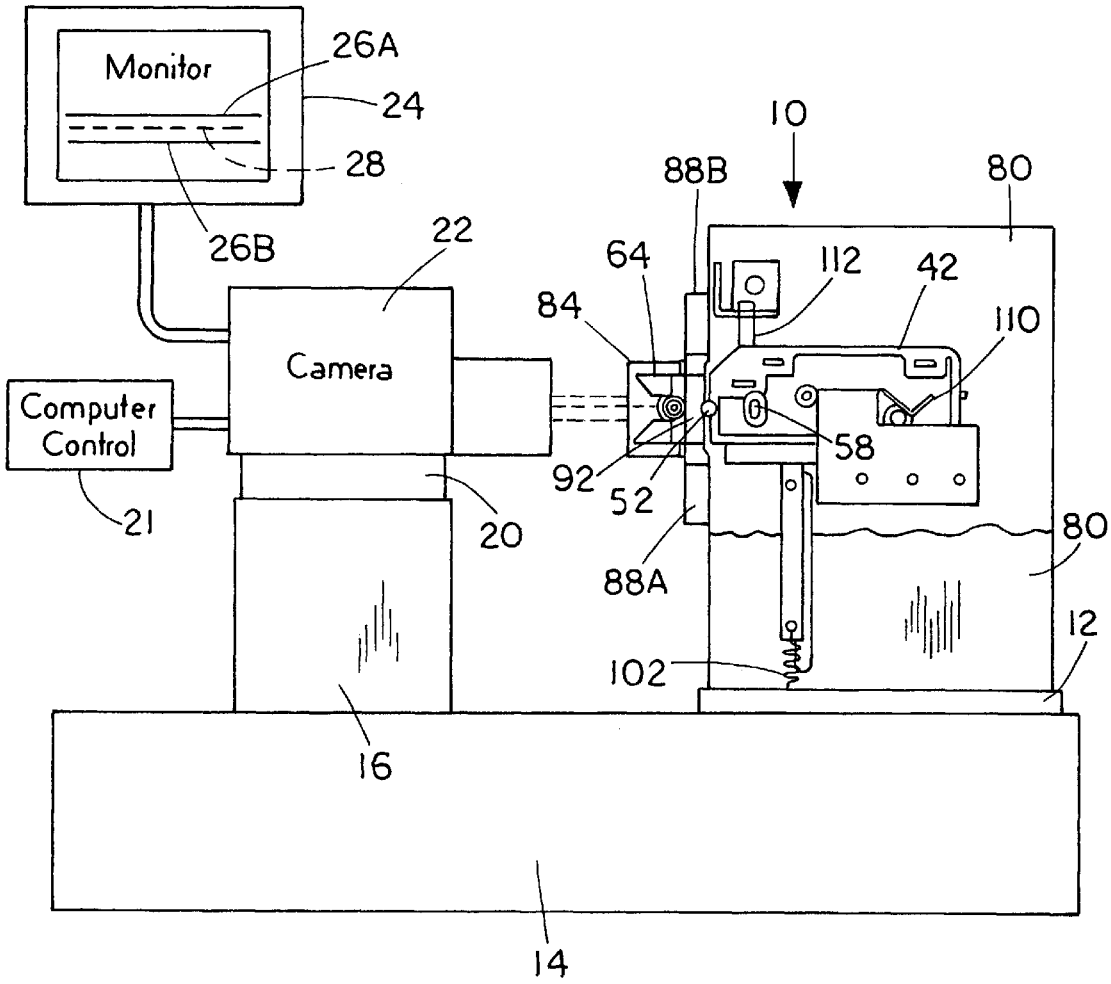
FIG. 1 is a schematic side view of a printhead alignment fixture, schematically showing the instrumentation used for determining appropriate alignment.

Referring to FIG. 1, the printhead and printhead mounting alignment fixture shown generally at 10 is made up of precisely machined parts including a base plate 12 that mounts onto a solid table or bench 14. The bench 14 is rigidly supported relative to the floor or other support. The bench has a slide table, much like a machine tool slide indicated at 16 on which a slide assembly 20 is mounted for movement laterally of the fixture 10. A camera 22, which can be any desired video camera that has high resolution, and is able to pick up an image on a printhead, showing the print pixel line, as will be explained. The camera 22 is controlled by a computer 21 and provides an input to a video monitor 24 that has a suitable screen on which the images received by the camera 22 can be displayed. The video monitor 24 can have reference lines indicated at 26A and 26B established on the screen. The reference lines can be used to determine when a line of a printhead in the fixture 10 as viewed by the camera is in the proper alignment or position. For example, the dotted line 28 between the reference lines 26A and 26B represents a properly aligned print line image viewed by the camera.

The fixture 10 supports a printhead mounting frame 30 which includes a main frame member 34 that has a frame back plate 35 extending laterally across the width of a printhead 36. The frame 34; and the back plate 35 have tabs that are bent out of the main portions of the frame as shown at 38 and 44 that will connect the main frame member 34 with side plates 42, 42 that are parallel and are on opposite ends or sides of the mounting frame 30. The side plates 42 are held securely on main frame 34 to become part of the mounting frame 30. The printhead 36 is mounted to the side plates so that the thermal elements or resistive elements at the printing line 40 are held in a desired location.

The backing plate 35, also has tabs that extend into receptacles on the side frame plates or members 42, to provide for a rigid mounting frame assembly 30.

The printhead 36 is directly mounted on a backing support plate 39 (see FIG. 4 where a side plate 44 is partially broken away) that extends parallel to back plate 35 and has tabs 48 that are used for mounting the printhead relative to pivot blocks 50 and to the side plates 42. The backing plate 39 is considered part of the printhead 36 in this specification. Tabs 48 are supported in a pair of pivot blocks 50, one on each of the side plates 42. The blocks 50 are pivotally mounted to the side plates 42 with dowel pins 52. The tabs 48 are slidably mounted in recesses or guide slots 54 formed in the mounting blocks 50, and a screw 58 passes through a clearance slot on each of the side plates 42, and threadably engages a threaded opening in the respective tabs 48, so that when tightening the screw 58, the tab 48 is secured tightly against the block 50. The guide slots 54 permit adjustment of the print line laterally of the side plates 42, and the pins 52 permit angular adjustment relative to a reference or datum plane established by the mounting frame, as will be explained.

The side plates 42 carry studs 60 that are precisely positioned near an upper end of the plates, as shown. The studs 60 have shank portions that will provide positive guiding of the side plates 42, the printhead mounting frame 30 and printhead 36 when supported on suitable supports on a housing, such as a printer housing.

The studs 60 are coaxial on the opposite sides of the mounting frame 30 and provide a reference axis or datum for one mounting of the mounting frame 30 and the printhead 36 relative to a housing. A second axis of reference or mounting is formed by forks 64 on the lower ends of the side plates 42. Each fork has a slot 62 in a lower end of the side plates 42. The slots 62 as shown, have tapered inlet surfaces 63 that will guide a shaft or pin to seat in the slot. The slots 62 are precisely formed with part cylindrical, so that when they seat on a support shaft or pin they will hold the side plate members, and thus the printhead supported thereon in a known reference position. The plane passing through the axis of pins 60 and through the aligning center lines of the part cylindrical surface forms a reference or support plane for alignment.

Figure 2:
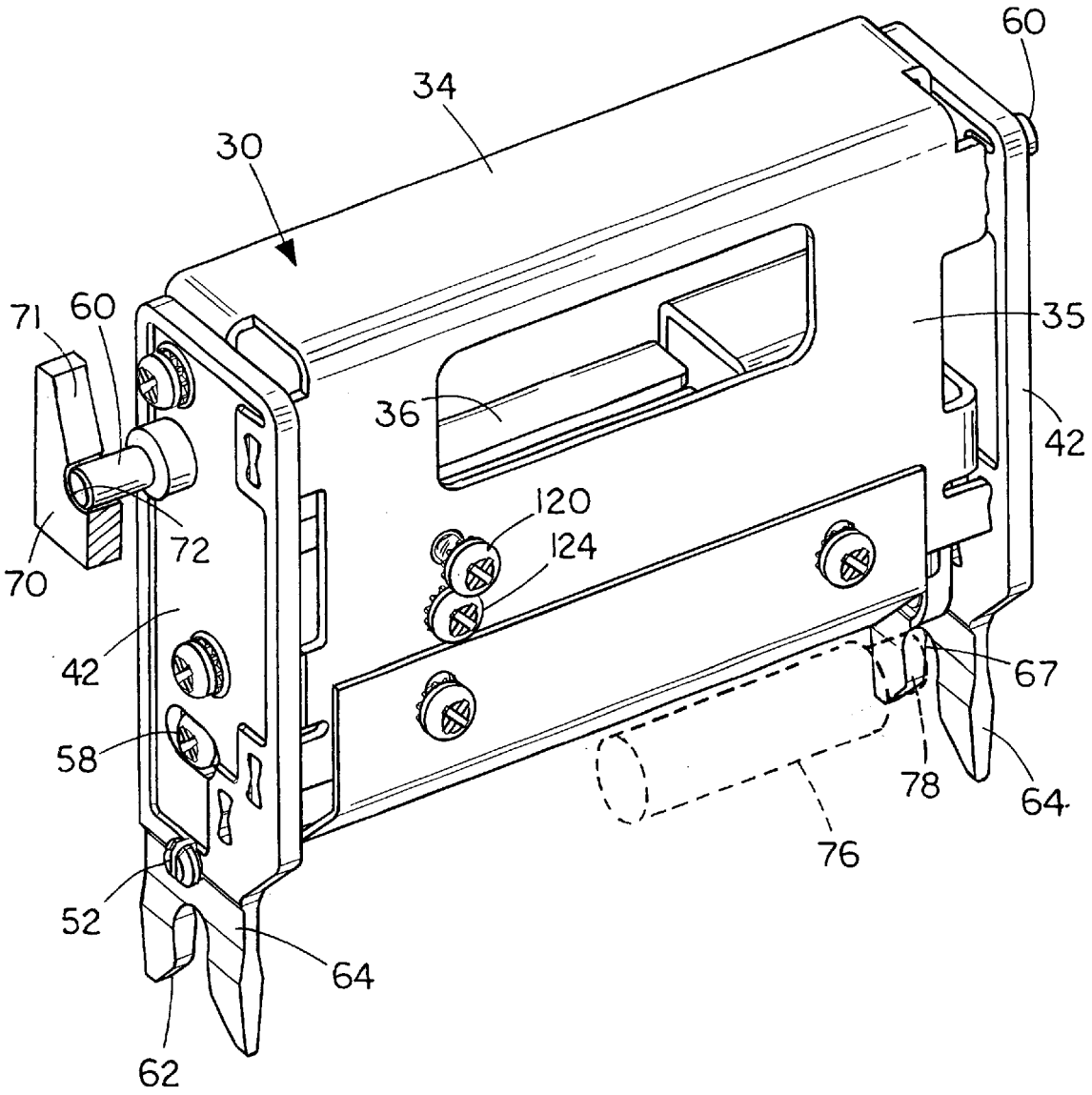
FIG. 2 is a perspective view of the printhead and mounting frame that is to be aligned with the fixture used with method of the present invention.
Figure 3:
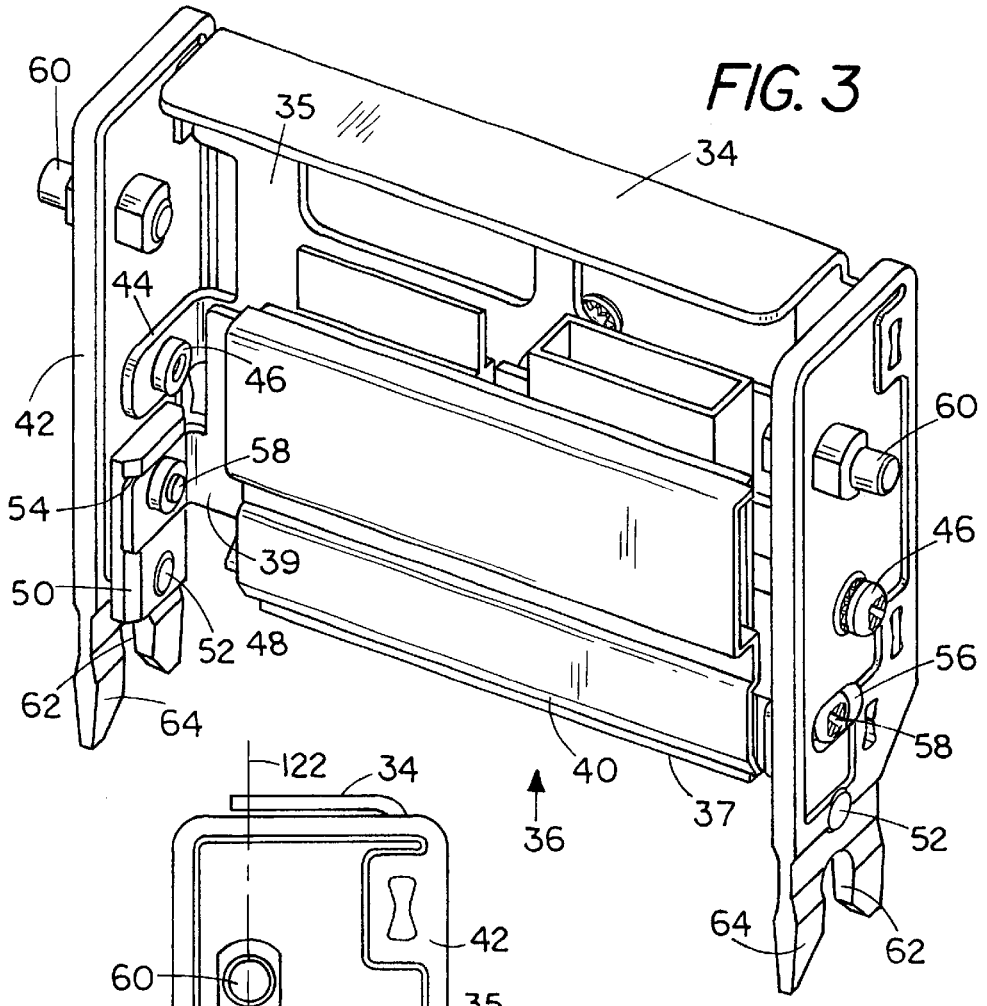
FIG. 3 is a perspective view of the printhead and printhead support frame from a side opposite that shown in FIG. 2.
Figure 9:
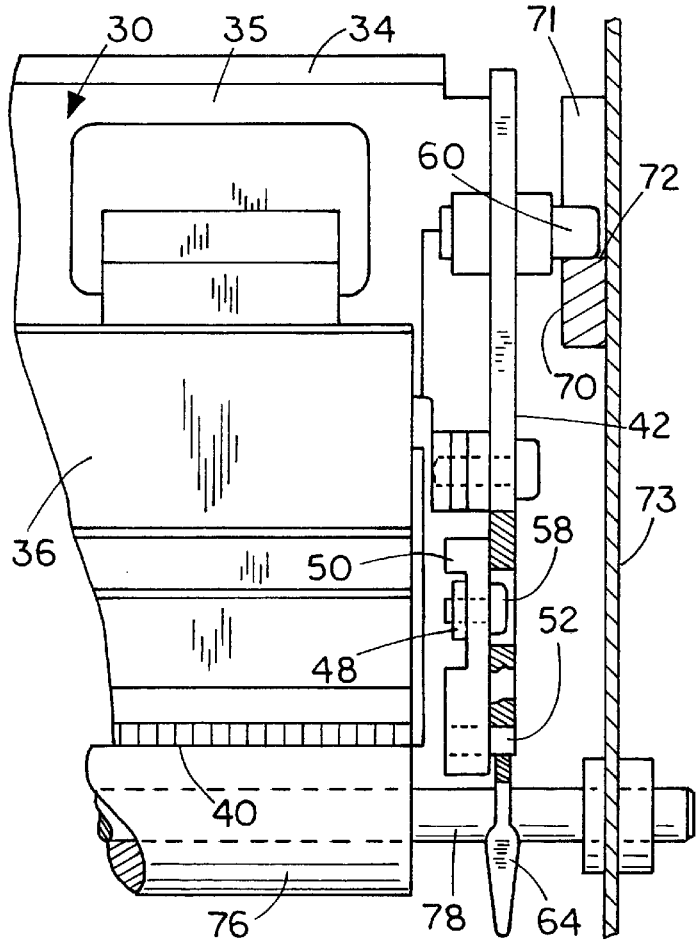
FIG. 9 is a schematic fragmentary view showing the printhead and printhead frame supported in relation to a printer housing.

By way of illustration, in FIGS. 2 and 9, a fixed guide member 70 is illustrated fragmentarily, to show that it has a part cylindrical receptacle 72 for receiving the stud 60. The guides 70 would be mounted onto a suitable housing plate 73, and as the mounting frame 30 is put into place, the studs 60 on each side are guided along a tapered guide surface 71 to seat into the part cylindrical receptacle 72 that closely holds the respective stud. The axis of the stud 60 would be in the proper datum. In FIGS. 2 and 9, a platen roller 76, that has a shaft 78 is shown schematically below the printhead print line 40. The shaft 78 is mounted in suitable bearings on the printer housing 73. The shaft 78 is of size to fit into the slot 62 of forks 64 and the part cylindrical end surface of the slots fit closely over the shaft 78. The side plates 42, when they are to be slid into position, will be guided over the shaft 78 by the tapered surfaces 63.

Figure 5:
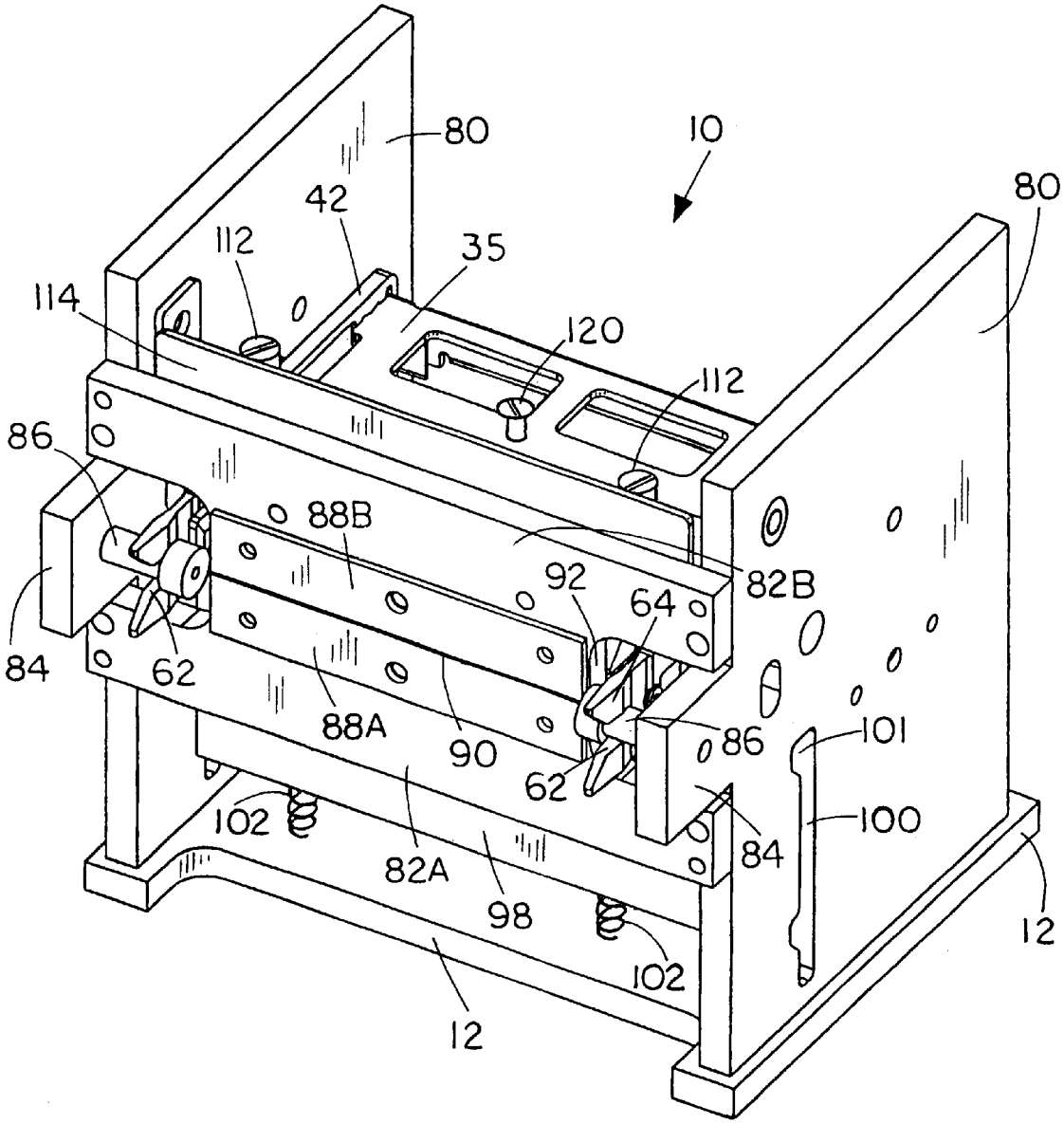
FIG. 5 is a perspective view of the fixture used for alignment of a printhead and mounting frame in accordance with the present invention, with one of the side plates partially broken away for showing components.

Referring to FIG. 5 and the alignment fixture, it can be seen fixture that the base 12 supports a pair of side walls 80, 80, that are parallel and spaced apart and held together with a suitable cross members 82A and 82B at the forward edge. The side walls 80 have forwardly projecting ears 84, 84 on which studs 86 are mounted. These studs 86 are the same size as the shaft 78 of the platen on which the printhead mounting frame is to be supported. It can be seen that the fork members 64 of the side plates 42 are slipped over these studs 86, so that the printhead mounting frame 30 is held at the same datum position as it would be when mounted on a shaft 78 of a platen roller. Forward cross member 82B is positioned above the cross member 82A and these cross members support plates 88A and 88B that define a narrow, transverse slit 90 between the plates 88A and 88B.

Figure 4:
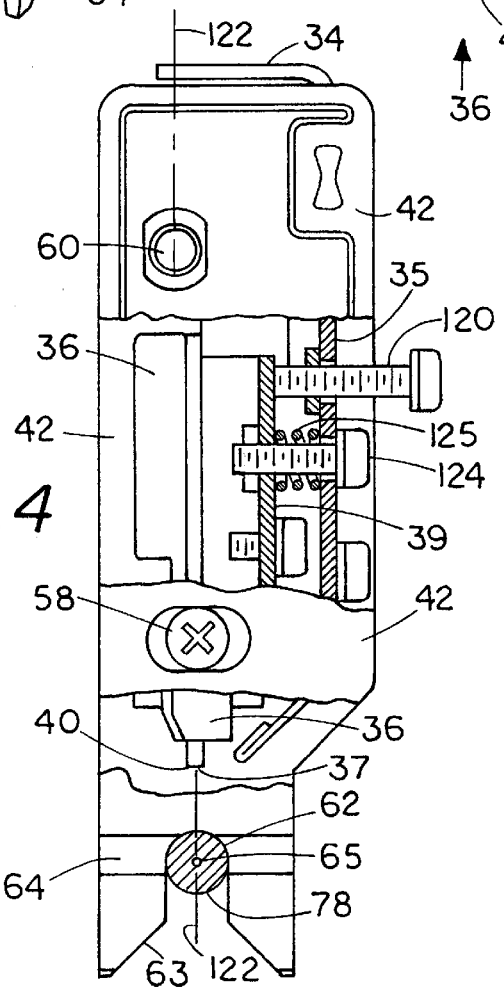
FIG. 4 is an end elevational view of the printhead of FIGS. 2 and 3.
Figure 8:
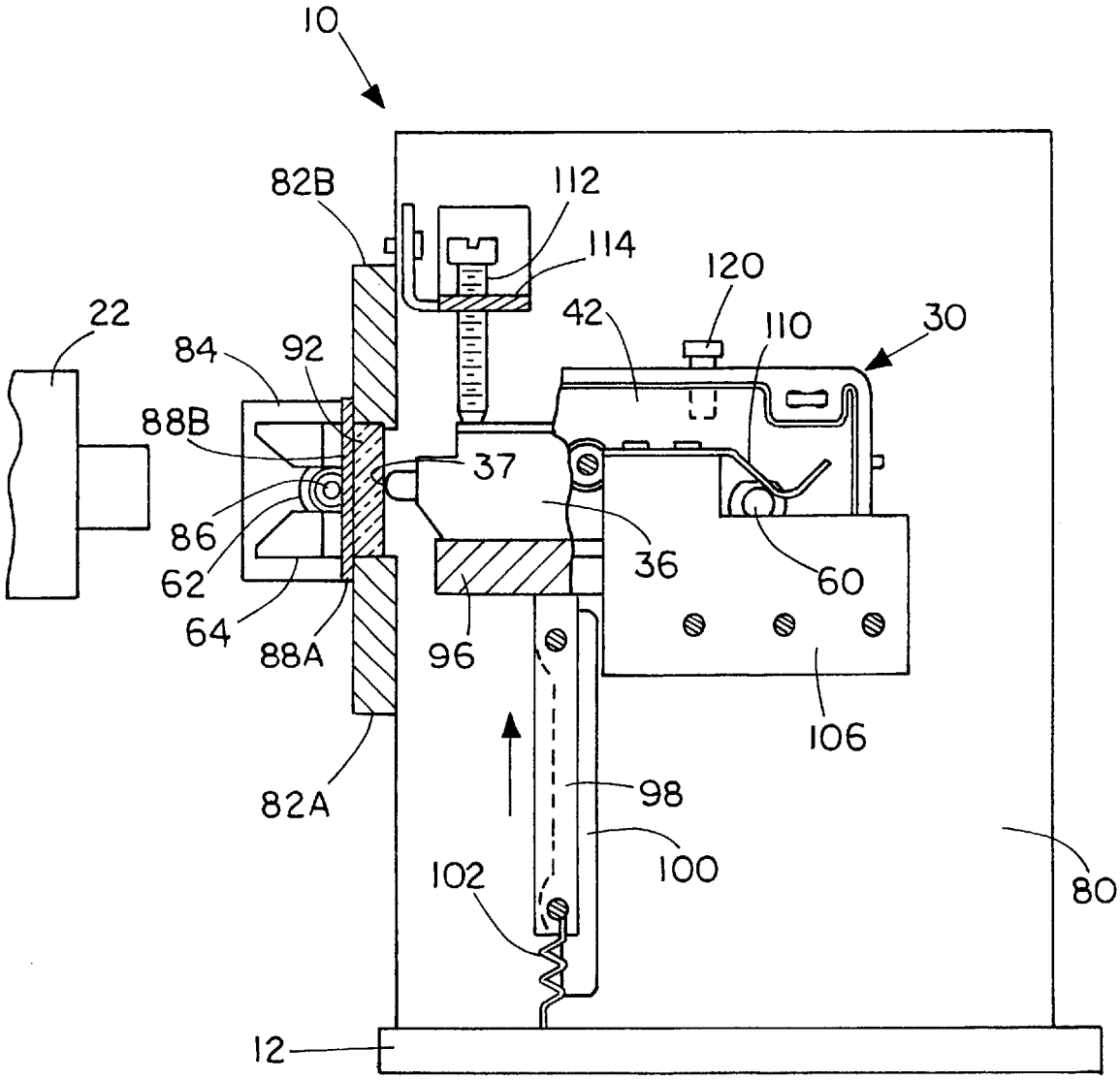
FIG. 8 is a side elevational view of the device of FIG. 5.

Additionally, as can be seen in FIG. 8, the cross members 82A and 82B support a flat pane or plates of transparent material, such as glass 92 that spans across the end edge of the printhead 36 that is in the fixture. The end of the printhead is part cylindrical at 37, as shown in FIG. 4 and represented in FIG. 8. The generally part cylindrical surface 37 bears against the flat surface of the plate 92 of glass under spring load, with line contact, and it is the line contact where the part cylindrical surface 37, which generally a ceramic material contacts the glass, that will show up on the camera image through the slit 90.

The mounting frame 30 and the printhead 36, are placed into the fixture 10 and the printhead is supported on a table 96, which in turn is supported by a cross member 98 that is slidably mounted in suitable vertical slots 100 on the fixture side plates 80. The printhead 36 is independently supported on table 96 so it can move for adjustment relative to the side plates 42. The table 96 and cross members 98 are spring loaded with a suitable springs 102 in an upward direction within the limits of guides shown at 101 in FIG. 5. A pair of fixed pillow or gage blocks 106 are precisely mounted onto the inside surface of side plates 80. The blocks 106 have rail edges 108 on which the studs 60 are supported. A suitable leaf spring 110 is provided on each of the blocks 106, and the springs 110 have V ends that bear against the respective studs 60 and provide a force downwardly against the rail 108 and also forwardly to tend to urge the part cylindrical printhead surface 37 against the glass pane 92.

With the screws 58 loosened, the positioning of the printhead along the slots 54 in the mounting blocks 50 can be changed for alignment. The pivotal position around the axes of dowel pins 52 can also be changed in the fixture.

The springs 102 push the printhead 36 upwardly, through the cross member 98 and table 96, and a pair of adjustment screws 112 are threadably mounted through support a cross flange 114 and bear against the opposite side of the printhead 36 from the table 96. By threading the adjustment screws 112, the position of the printhead 36 can be changed to move the printhead up and down (laterally of reference plane 122, see FIG. 4) in the slots 54, while the side plates 42 remain stationary and supported on the studs 60 and 86.

When the printhead mounting frame 30 and printhead 36 are positioned in the fixture 10, the studs 60 are supported on the rails 108 and urged forwardly, and the forks 64 are mounted onto the studs 86 of the fixture. Thus, the mounting frame is held in a known position relative to the camera. The reference plane 122 is established by the axes of studs 60 and axis 65 of the part cylindrical surfaces of the slots 64.

The screws 112 are moved to engage the printhead in two locations, with the screws 58 loosened. The camera 22 is operated by computer 21, and the position of the line of contact between the end surface 37 of the print element and the glass plate 90 are shown on the video monitor. The adjustments are made with the screws 112 until the line of contact, which is essentially the print line 40, is within the reference lines on the monitor, at which time the screws 58 are tightened down. This is the lateral adjustment relative to the reference plane 122. The camera 22 is moved along the slide 20 parallel to the line of contact between the printhead surface 37 and the glass plate 92 and the position of the line of contact adjacent the ends of the printhead are verified. That is, the positioning of the line adjacent the side frame plates 42 is observed closely.

The individual screws 58 can be loosened and tightened as needed until the printhead is properly laterally positioned in the mounting frame 30, and then the screws 58 tightened to hold the printhead securely in the blocks 50.

The angle of the plane of the printhead relative to the plane 122, which is established by the axes of the support studs 60 and the axis of the end surface of slot 62 is adjusted by adjusting a spring loaded angle adjustment screw 124 that threads into a nut on plate 39 supporting the printhead. A spring 125 is mounted on screw 124 and urges the printhead away from back wall 35. A lock screw 120 which, as shown in FIG. 4, threads through a nut secured to back wall 35 of the mounting frame 30 will bear against the back plate of the printhead and hold it from moving back toward wall 35.

The side plate 42 has been broken away in FIG. 8 to show the rounded end 37 of the printhead edge that will bear against the plate 92 of glass during the adjustment sequence in the fixture 10.

The angle of the printhead relative to the plane 122, and the transverse or lateral position of the printhead along the slots 54 are both thus fixed and the print line 40 represented by the contact line between surface 37 and the glass pane 92 will be maintained at the proper position relative to reference plane 122.

Various test parameters can be used so an optimized zone for the print line is established by tests. When the contact line between the surface 37 of the printhead and the fixture glass pane plate 92 is within the set tolerances displayed on the monitor screen, which can be programmed into the display software of the computer 21, the print line contact will be known to be proper along the surface of the platen.

Figure 10:
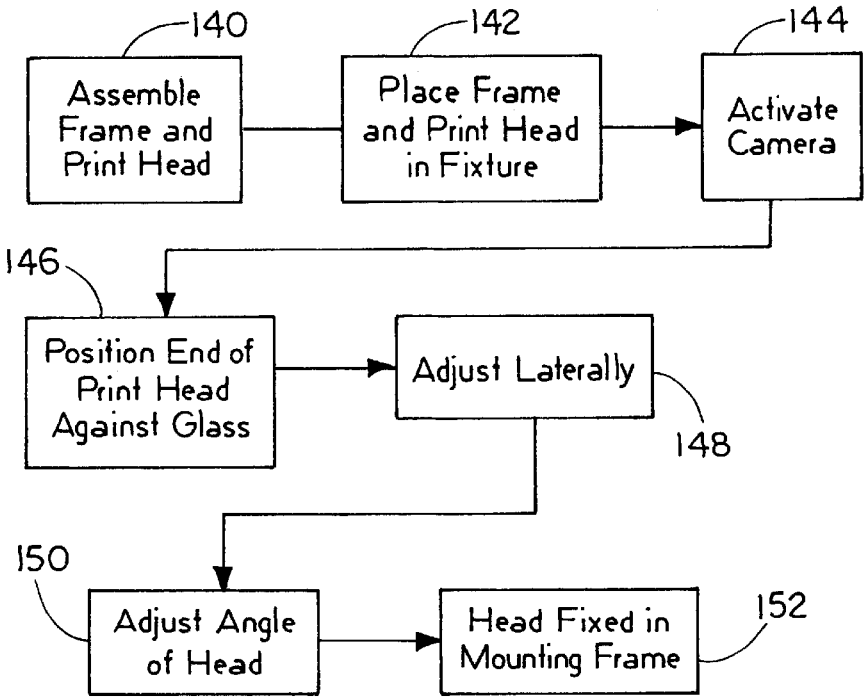
FIG. 10 is a block diagram flow chart showing the process of alignment using the printhead, the mounting frame, and fixture of the present invention.

Referring to FIG. 10, a block diagram flow chart is illustrated. The printhead 36 and printhead mounting frame 30 are supported together, with the screw 58 loosened, as a first step The printhead mounting frame and printhead are placed in the test fixture. The assembly of the printhead and printhead frame indicated by the block 140, and placing the printhead mounting frame 30, with the printhead installed, into the alignment fixture 10 illustrated in the block 142. The camera and monitor are activated as indicated by the block 144 and the print line is positioned against the reference surface of the glass pane 92 as indicated by the block 146. Then the lateral adjustment of the printhead relative to the side members 42 is accomplished by adjusting the adjustment screws 112, to move printhead and the table 96, with the screw 58 loosened. The screws 120 and 124 are then adjusted to adjust the pivotal position about the dowel pin 52, which adjusts the angle of the printhead relative to the reference plane defined by the axes of the studs 60 and the part cylindrical surface of slot 62, which will be supported in the fixture 10 on the studs 86. The lateral adjustment of the printhead is indicated by the block 148, and the angle adjustment is indicated by the block 150 in the flow chart of FIG. 10. Once the angle adjustment has been made, a further lateral adjustment may be made. Then, the printhead is fixed in place as indicated by the block 152., relative to the outer printhead mounting frame 30.

The mounting frame 30 can then be used in its mounting environment, and the printhead will be held precisely once the studs 60 and the slots 62 are in position on their respective guides. The slot 62 is guided over the shaft of the platen used with the printhead.

Because the reference plane 122 is established precisely with respect to the print line of the printhead, optimized printing can occur.

Although the present invention has been described with reference to preferred embodiments, workers skilled in the art will recognize that changes may be made in form and detail without departing from the spirit and scope of the invention.

What is claimed is:

1. A support frame for a working part having an edge, the working part being supported in a mounting frame having a pair of side plates with a frame portion holding the side plates spaced apart, the working part fitting between the side plates, said side plates each having a pair of spaced supports that lying on a reference plane for orientation of the working part, a pivot block mounted on each of the side plates, said pivot block having a guide for the working part for adjustable movement relative to the pivot block in a direction laterally of the reference plane, a lock for holding the working member in each of the pivot blocks at a desired lateral position relative to the reference plane, and an adjustable support between the mounting frame and the working part for adjustably moving the working part about the pivot axis relative to the mounting frame.

2. The support frame of claim 1, wherein the spaced supports on the side plates comprise laterally extending studs and a cylindrical receptacle, each having a central axis lying in the reference plane.

3. The support frame of claim 1, wherein the working part is a printhead having a print line along the edge.

4. The support frame of claim 3 in combination with an alignment assembly supporting the support frame, including a fixture, and wherein the fixture has a reference plane formed by a wall of transparent material, and a spring urging the print line against the reference plane.

5. The combination of claim 4, wherein the alignment assembly includes a video camera for viewing a line of contact between the printhead and the transparent wall.

6. The combination of claim 5 and a support for the camera forming a reference plane on a side of the transparent member opposite the printhead, said camera having a readout means for determining the position of the line of contact relative to established reference lines.

7. A fixture for supporting a support frame for a printhead having an edge defining a line, at least two supports on opposite sides of said support frame for establishing a reference plane of support, the fixture permitting alignment of the line in a direction laterally of the reference plane and adjustment of the printhead angularly on the support frame relative to the reference plane;

said fixture supporting said support frame on the supports on opposite sides of the support frame, to establish the reference plane at a known location;

a camera positioned for viewing the reference line along the edge;

a said support frame having side members, a pivot block pivotally mounted on each side member about a pivot axis substantially parallel to the reference plane, a support tab between each pivot block and the printhead being adjustable on the pivot block in a direction laterally of the reference plane; and an adjustable connection between the printhead and the support frame spaced from the pivot axis to permit changing the angle of the printhead about the pivot axis relative to the support frame.

8. The fixture of claim 7, wherein said camera is movably mounted for movement substantially parallel to the edge of the printhead, and a monitor to display the edge as viewed by the camera.

9. The fixture of claim 7, and a support on the fixture to support the printhead independently of the support frame, and further including an adjustment device on the fixture for moving the printhead laterally relative to the printhead support frame when the tabs are released from the pivot block.

10. The fixture of claim 9 and a bias member urging the support frame toward a wall panel forming a second reference plane for the edge of the printhead.

11. The fixture of claim 10, wherein the panel forming a second reference plane comprises a transparent panel against which the edge of the printhead is urged, the printhead having a part cylindrical surface at its edge to form a line of contact with the transparent panel.

12. The fixture of claim 11, and a pair of walls on the fixture, said walls having edges defining a narrow slit between the walls, said slit being substantially parallel to the line of contact between the part cylindrical surface of the printhead and of the transparent panel.

13. The fixture of claim 12, and a monitor for receiving images viewed by the camera and displaying the line of contact between the panel and the part cylindrical surface of the edge of the printhead relative to reference locations on the monitor.

14. A method of adjusting a printhead relative to a printhead support frame, comprising:

mounting the printhead in the support frame, the support frame having a pair of side members between which the printhead is positioned;

pivotally mounting a support block on each of the side members;

positioning the printhead in the support frame between the side members;

mounting the support frame in a fixture at a reference position using reference support members on the support frame defining a reference plane;

determining the position of a print line on the printhead relative to the reference plane;

adjusting the printhead relative to the support frame and reference plane to move the print line on the printhead into a reference position; and fixing the printhead to the support frame in the adjusted position.

15. The method of claim 14 including first adjusting the printhead on the pivot blocks in a direction laterally of the reference plane, and then adjusting the angular position of the printhead relative about the pivot axis relative to the reference plane.

* * * * *